US006270067B1

(12) United States Patent
Bergmann et al.

(10) Patent No.: US 6,270,067 B1
(45) Date of Patent: Aug. 7, 2001

(54) APPARATUS FOR SLOWING DOWN PRODUCTS IN ROTARY PRINTING MACHINES

(75) Inventors: Stephan Bergmann; Ralf Werner, both of Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/492,901

(22) Filed: Jan. 27, 2000

(30) Foreign Application Priority Data

Jan. 27, 1999 (DE) ..... 199 03 120

(51) Int. Cl.[7] ..... B41F 13/64

(52) U.S. Cl. ..... 270/13; 270/38; 270/47; 101/232; 271/182

(58) Field of Search ..... 270/13, 12, 14, 270/19, 20.1, 21.1, 38, 47, 45; 101/232; 271/182, 277; 493/429

(56) References Cited

U.S. PATENT DOCUMENTS

| | | | | |
|---|---|---|---|---|
| 4,682,767 | * | 7/1987 | Littleton | 270/45 |
| 5,039,082 | * | 8/1991 | Littleton | 271/182 |
| 5,102,111 | * | 4/1992 | Reponty | 270/12 |
| 5,103,703 | * | 4/1992 | Littleton | 83/155 |
| 5,165,674 | * | 11/1992 | Petersen | 270/47 |
| 5,174,557 | * | 12/1992 | Meier | 270/38 |
| 5,236,188 | * | 8/1993 | Breton et al. | 101/232 |
| 5,439,206 | * | 8/1995 | Raasch et al. | 270/20.1 |
| 5,443,256 | * | 8/1995 | Ertavi et al. | 271/277 |
| 5,520,378 | * | 5/1996 | Kepert et al. | 493/429 |
| 5,522,586 | * | 6/1996 | Bennett et al. | 270/21.1 |
| 6,038,974 | * | 3/2000 | Richards | 101/232 |

FOREIGN PATENT DOCUMENTS

| | | |
|---|---|---|
| 627018 | 4/1932 | (DE) . |
| 2407 576 C2 | 3/1982 | (DE) . |
| 2541 502 C3 | 12/1983 | (DE) . |
| 3321 811 A1 | 12/1984 | (DE) . |
| 246 006 A3 | 5/1987 | (DE) . |
| 3418 344 C2 | 8/1987 | (DE) . |
| CH 664 328 A5 | 2/1988 | (DE) . |
| 3910 333 C1 | 3/1990 | (DE) . |
| 3735 303 C2 | 5/1991 | (DE) . |
| 3940 960 A1 | 7/1991 | (DE) . |
| 4219 982 A1 | 12/1993 | (DE) . |
| 4316 051 A1 | 12/1993 | (DE) . |

* cited by examiner

*Primary Examiner*—Eugene Eickholt
(74) *Attorney, Agent, or Firm*—Cohen, Pontani, Lieberman & Pavane

(57) ABSTRACT

An apparatus for slowing down products in the folder of rotary printing machines. A product-directing system is arranged between the jaw cylinder and paddle wheel, and a driven decelerating-roller pair is integrated into the product-directing system. In order to provide an apparatus which can be adjusted in a straightforward manner and ensures that the products are slowed in a functionally reliable manner upstream of the paddle wheel, the circumference of the decelerating rollers is equal to at least one product length, and the decelerating-roller pair is driven at a non-uniform speed.

11 Claims, 2 Drawing Sheets

APPARATUS FOR SLOWING DOWN PRODUCTS IN ROTARY PRINTING MACHINES

BACKGROUND OF THE INVENTION

1. Field of the Invention

The invention relates to printing machines and more particularly to an apparatus for slowing down products in the folder of rotary printing machines.

2. Description of the Related Art

DD 246 006 A3 discloses an apparatus of the generic type having a decelerating-roller pair. At least one decelerating roller has a strip which cyclically groups the products at their trailing end along with the other decelerating roller. Additionally, in each case one transporting-roller pair is arranged upstream and downstream of the decelerating-roller pair, as seen in the transporting direction, and is driven at the speed of, and in sync with, the incoming products. At least one transporting roller of the downstream transporting-roller pair includes a transporting segment.

SUMMARY OF THE INVENTION

It is an object of the invention to provide an apparatus for slowing down products in the folder of a rotary printing machine which can be adjusted in a straightforward manner and ensures that the products are slowed down in a functionally reliable manner upstream of the paddle wheel.

This and other objects are achieved in accordance with the invention by virtue of constant contact of the decelerating rollers of the product in conjunction with a speed profile for the decelerating rollers which is optimally coordinated with the decelerating process. The invention makes it possible for the products to be slowed down reliably and carefully and thus to be delivered by the paddle wheel with a higher level of accuracy. The deceleration of the products by one roller pair requires little adjustment outlay since there is no need to coordinate the speeds of the plurality of roller pairs.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is explained in more detail hereinbelow with reference to an exemplary embodiment. In the associated drawings.

DETAILED DESCRIPTION OF THE PRESENTLY PREFERRED EMBODIMENTS

Figure 1:
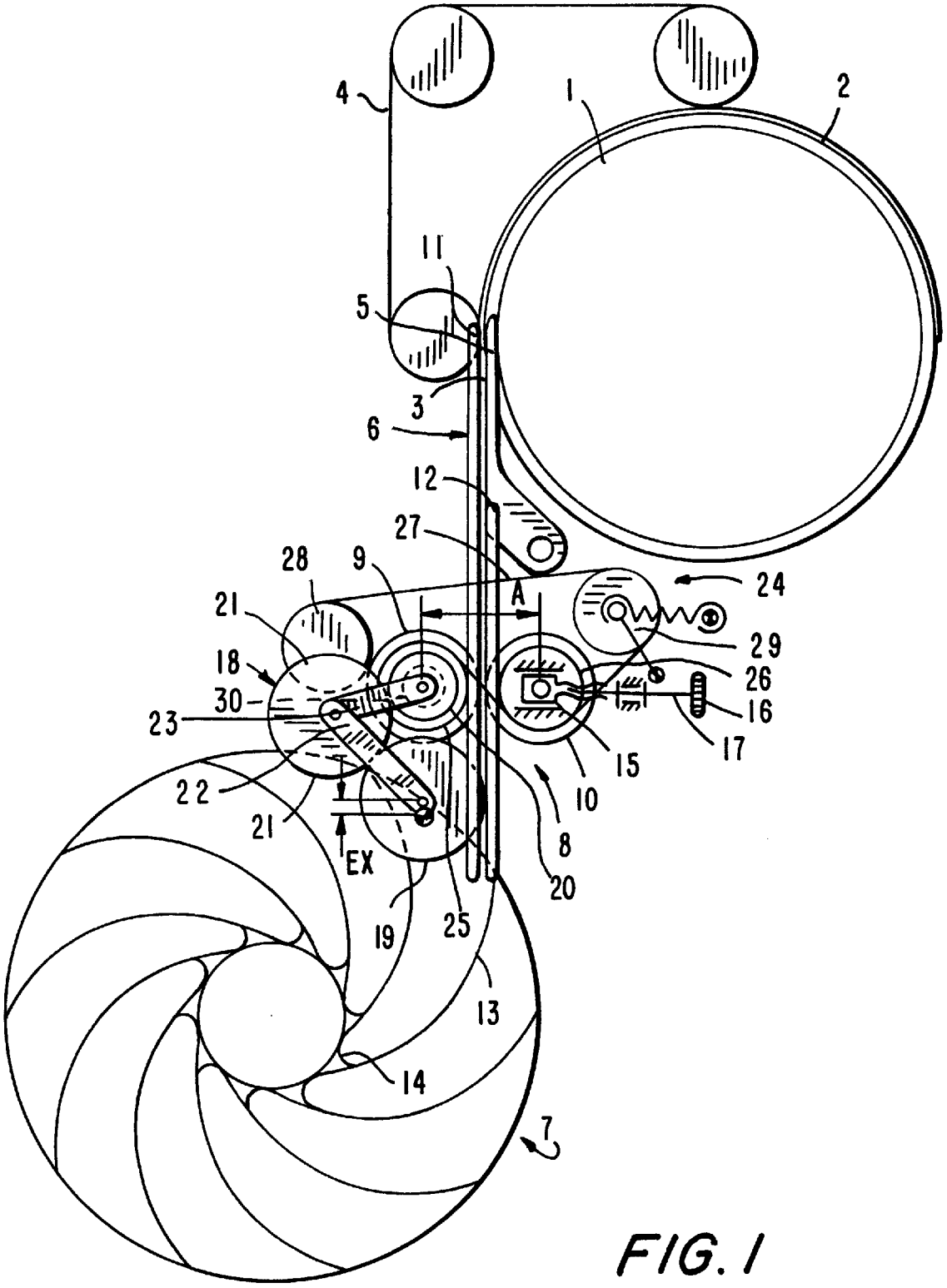
FIG. 1 is a schematic plan diagram of an apparatus for slowing down the products between a jaw cylinder and a paddle wheel by means of a decelerating-roller pair according to an embodiment of the invention.

FIG. 1 shows a jaw cylinder 1 of a folder which, in a manner which is not illustrated, in interaction with the folding-blade cylinder, cross folds the cut-to-length folding sheets to give the products 2 or 3 illustrated in FIG. 1. An interspace equal to one product length is produced between the products 2 and 3. A driven belt directing system 4 wraps around part of the jaw cylinder 1 and keeps the products 2, 3 in contact with the jaw cylinder 1 following the folding operation as far as a product-directing system 6 which starts tangentially to the circumference of the jaw cylinder 1 and receives the products from the latter by means of the stripper 5.

The product-directing system 6 includes a plurality of directing rails 11, 12 which support the product 3 on both sides. The directing rails 11, 12 are spaced apart from one another transverse to the running direction of the products, and extend into the region of a paddle wheel 7. In the process, the directing rails 11, 12 pass through the first decelerating roller 9 and second decelerating roller 10, respectively in annular circumferential cutouts, of a decelerating-roller pair 8.

The decelerating rollers 9, 10 are in constant contact with the product 3, and transport it without slippage. The decelerating rollers 9,10 are driven at a non-uniform speed such that their circumferential speed corresponds to the transporting speed of the incoming product 2 at the start of a product 3 and decreases towards the end of the same, with the result that the product 3 is braked as it slides in each case into a paddle 13 of the paddle wheel 7. Paddle wheel 7 provides an imbricated delivery of the products 2, 3. The circumferential speed of the decelerating rollers 9, 10 at the end of the decelerated product 3 is still higher than the speed at which the product is delivered by the paddle wheel 7. In an interspace remaining between the end of the decelerated product 3 and the start of the following product 2, the decelerating rollers 9; 10 are accelerated again to the transporting speed of the following product 2.

The careful deceleration of the products 2, 3 upstream of the paddle wheel 7 reduces the impact of said products in the paddle base 14, which aids in damage free, aligned delivery of the products 2, 3 by the paddle wheel 7.

For adjustment to different product thicknesses, the second decelerating roller 10 is mounted such that it can be adjusted to change the centre-to-centre distance A between the decelerating rollers 9, 10. For this purpose, in each case one adjusting spindle 17 equipped with an operating element 16 acts, by way of example, on bearing mounts 15 of the second decelerating roller 10 which are arranged such that they can be displaced in the framework perpendicular to the transporting direction of the products.

The first decelerating roller 9, which is mounted in a stationary manner in the framework, is driven in a non-uniform manner by a coupling gear mechanism 18 which comprises a first spur gear wheel 19, which is mounted in the framework with an eccentricity Ex and is connected to the drive of the folder or one of the driven mechanisms thereof. An intermediate spur gear wheel 21 is in engagement with first spur gear wheel 19 and a second spur gear wheel 20 that is coaxially connected to the first decelerating roller 9. In each case, one connecting rod 22; 23 connects the intermediate spur gear wheel 21 to the first spur gear wheel 19 and the second spur gear wheel 20, respectively. The connecting rods 22, 23 are coaxially articulated on the spur gear wheels 19, 20.

The second decelerating roller 10 is driven by the first decelerating roller 9 by way of a drawing-means drive 24. One crown gear 25, 26 is coaxially fastened on the respective decelerating rollers 9, 10; and the crown gears 25, 26 are connected, by way of an endless drawing means 27 (as chain or toothed belt), to one strand directly and to the other strand via two intermediate crown gears 28, 29. Intermediate crown gear 29, is mounted such that it can be pivoted in a spring-loaded manner in order to tension the drawing means 27.

If the coupling gear mechanism 18 is dispensed with, it is also possible for the first decelerating roller 9, in accordance with the dashed illustration in FIG. 1, to be driven directly by a motor 30 which can be regulated in accordance with a speed profile prescribed to a control unit by a computer. If the drawing-means drive 24 is dispensed with, it is likewise possible, analogously, for the second decelerating roller 10 to be driven individually by a motor (not illustrated).

Figure 2:
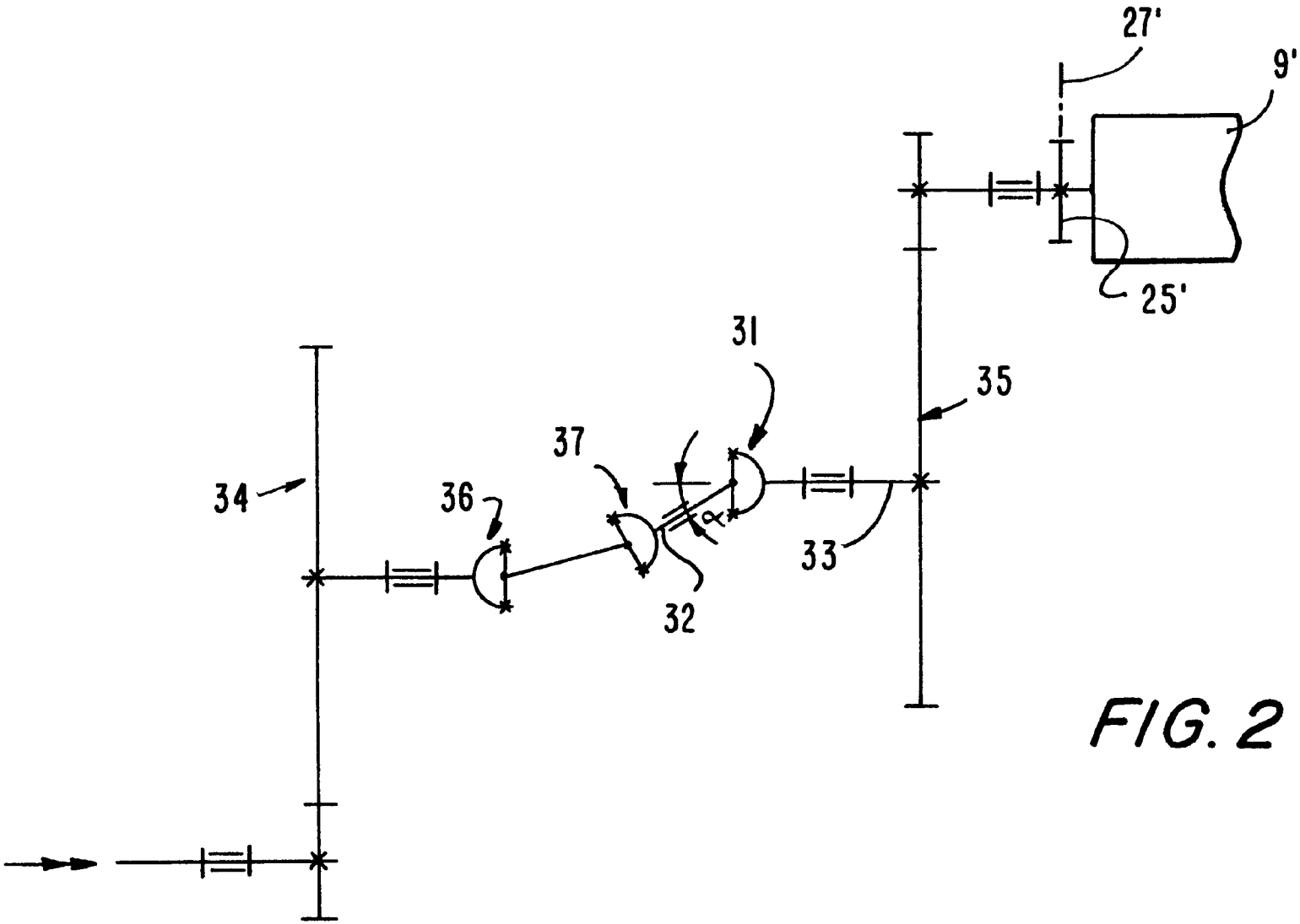
FIG. 2 is a schematic diagram of the drive of a decelerating roller by means of a shaft articulation as an alternative embodiment of a coupling gear mechanism according to FIG. 1.

Finally, as a further drive embodiment as shown in FIG. 2, it is possible for the first decelerating roller 9' to be driven in a non-uniform manner by means of a shaft articulation 31, of which the input shaft 32 is pivoted through an angle $\alpha$ in relation to the output shaft 33 thereof, the output shaft being axis-parallel with the first decelerating roller 9'. This means that the angle of rotation of the input shaft 32 deviates non-uniformly in relation to the angle of rotation of the output shaft 33. Gear-wheel stages 34, 35 bring the movement characteristics of the shaft articulation 31 into line with the requirements of the decelerating roller 9'.

Two further shaft articulations 36, 37, which are arranged upstream of the shaft articulation 31, serve to compensate for the angle $\alpha$ in the drive guide.

One of ordinary skill in the art will recognize that the deceleration rollers 9; 9'; 10 may also comprise a plurality of rollers which are fixed to a shaft in an axially offset manner, where the rollers may expediently be in contact with the products at print-free locations.

The invention is not limited by the embodiments described above which are presented as examples only but can be modified in various ways within the scope of protection defined by the appended patent claims.

We claim:

1. An apparatus for slowing down products in a folder of a rotary printing machine comprising:

a jaw cylinder;

a paddle wheel for delivering folded products such that they are over lapped in an imbricated stream;

a product directing system arranged between said jaw cylinder and said paddle wheel; and a driven decelerating-roller pair operatively integrated into said product directing system and being in constant slippage-free contact with the product, wherein a circumference of decelerating rollers of the decelerating roller pair is equal to at least one product length;

said decelerating-roller pair being driven at a non-uniform speed such that a circumferential speed of said rollers corresponds to a transporting speed of the incoming product at the start of the product and is consistently reduced towards the end of the product, wherein the speed of the rollers is greater at the end of the product than a delivery speed of the paddle wheel for the products;

wherein acceleration of the decelerating-roller pair to the transporting speed of a following product occurs in an interspace remaining between the end of a preceding product and the start of a following product in a transporting direction.

2. The apparatus according to claim 1, further comprising a center-to-center distance between the decelerating-rollers of the roller pair, said center-to-center distance being adjustable to accommodate different product thicknesses.

3. The apparatus according to claim 1, wherein said decelerating-rollers are driven together.

4. The apparatus according to claim 1, wherein each decelerating roller of said pair is driven individually by a motor that is capable of being regulated in accordance with a speed profile prescribed to a control unit by a computer.

5. The apparatus according to claim 1, further comprising:

a coupling gear mechanism for driving a first decelerating-roller of said pair, said coupling gear mechanism comprising:

a first spur gear wheel eccentrically mounted in a framework and connected to a drive for mechanisms of the folder;

an intermediate spur gear wheel operatively engaging said first spur gear;

a second spur gear wheel coaxially fixed to said first decelerating-roller and operatively engaged with said intermediate spur gear and thereby in operative engagement with said first spur gear; and a connecting rod mounted in a pivotable manner coaxially with said first spur gear wheel and second spur gear wheel such that said intermediate spur gear wheel is articulated on the first spur gear wheel and second spur gear wheel;

wherein said first decelerating-roller is in a drive connection with a second decelerating-roller of said pair.

6. The apparatus according to claim 5, further comprising a drawing means drive for driving said first decelerating-roller, said second roller being driven by said first decelerating-roller.

7. The apparatus according to claim 6, wherein said drawing means drive comprises:

two crown gears coaxially fixed to the two decelerating-rollers of said pair;

at least one intermediate crown gear; and endless drawing means adapted to wrap around said two crown gears and said at least one intermediate crown gear independent of a direction of rotation of the decelerating-rollers.

8. The apparatus according to claim 7, wherein said intermediate crown gear includes an axis and comprises a spring-loaded mounting adapted to selectively displace said axis; and wherein the first and second decelerating-rollers comprise a center-to-center distance, said second decelerating-roller being mounted to selectively change said center-to-center distance.

9. The apparatus according to claim 1, further comprising a shaft articulation for driving at least one decelerating-roller, said shaft articulation comprising an input shaft and an output shaft, said input shaft being pivoted through an angle in relation to said output shaft.

10. The apparatus according to claim 1, wherein said product directing system comprises:

directing rails extending into a region of the paddle wheel tangentially from a circumference of the jaw cylinder, said directing rails receiving the products from the jaw cylinder; and a stripper for enabling said directing rails to receive the products from the jaw cylinder and pass through annular circumferential cutouts in the decelerating-rollers and thereby provide multiple lateral guidance for the products transverse to a running direction.

11. The apparatus according to claim 1, wherein said decelerating-rollers of said pair each comprise rollers arranged on a shaft in an axially offset manner, said rollers selectively coming into contact with print-free zones of the products.

* * * * *